US010228149B2

(12) United States Patent
Kasugai et al.

(10) Patent No.: US 10,228,149 B2
(45) Date of Patent: Mar. 12, 2019

(54) OUTDOOR UNIT OF AIR CONDITIONER

(71) Applicant: FUJITSU GENERAL LIMITED, Kawasaki-shi, Kanagawa-ken (JP)

(72) Inventors: Satoshi Kasugai, Kawasaki (JP); Rikio Mizuguchi, Kawasaki (JP)

(73) Assignee: FUJITSU GENERAL LIMITED, Kawasaki-Shi, Kanagawa-Ken (JP)

( * ) Notice: Subject to any disclaimer, the term of this patent is extended or adjusted under 35 U.S.C. 154(b) by 0 days.

(21) Appl. No.: 15/596,673

(22) Filed: May 16, 2017

(65) Prior Publication Data

US 2017/0343223 A1 Nov. 30, 2017

(30) Foreign Application Priority Data

May 31, 2016 (JP) ..... 2016-108334

(51) Int. Cl.

| | |
|---|---|
| ***F24F 1/38*** | (2011.01) |
| ***F24F 13/08*** | (2006.01) |
| ***F24F 13/20*** | (2006.01) |
| ***F24F 1/40*** | (2011.01) |
| ***F24F 1/50*** | (2011.01) |

(52) U.S. Cl.

CPC ..... *F24F 1/38* (2013.01); *F24F 1/40* (2013.01); *F24F 1/50* (2013.01); *F24F 13/082* (2013.01); *F24F 13/20* (2013.01)

(58) Field of Classification Search

None

See application file for complete search history.

(56) References Cited

FOREIGN PATENT DOCUMENTS

JP 5402987 B2 1/2014

OTHER PUBLICATIONS

Machine Translation of JP2003214658A.*
Drawings of JP2003214658A.*

* cited by examiner

*Primary Examiner* — Jianying C Atkisson
*Assistant Examiner* — Nicholas Roth Hector
(74) *Attorney, Agent, or Firm* — Manabu Kanesaka

(57) ABSTRACT

An outdoor unit of an air conditioner which is capable of increasing mechanical strength of a fan guard to suppress deformation of the fan guard, and further, is capable of preventing generation of a chattering sound is provided. A diameter of wire rods which configure a lateral rail portion of the fan guard is greater than a diameter of wire rods which configure a longitudinal rail portion of the fan guard, cross-sectional crank shaped fixing plates are provided on both left and right end portions of the lateral rail portion, and the fan guard is screwed to the top panel via the fixing plates.

5 Claims, 5 Drawing Sheets

OUTDOOR UNIT OF AIR CONDITIONER

RELATED APPLICATIONS

The present application is based on, and claims priority from, Japanese Application No. JP2016-108334 filed May 31, 2016, the disclosure of which is hereby incorporated by reference herein in its entirety.

BACKGROUND OF THE INVENTION

1. Field of the Invention

The present invention relates to an outdoor unit of an air conditioner, and more particularly to an upward blow-out type outdoor unit in which a blower chamber is disposed on a top portion of a machine chamber which includes a heat exchanger and a compressor.

2. Background Art

A multi-type air conditioner in which a plurality of indoor units are connected to a single outdoor unit is an example of an air conditioner. For example, as described in Japanese Patent No. 5402987, the outdoor unit of the air conditioner includes a rectangular parallelepiped housing, and the inner portion of the housing is partitioned into a machine chamber which includes a heat exchanger and a compressor, and a blower chamber which includes a blower. The machine chamber is disposed on the bottom portion of the housing, the blower chamber is disposed on the top portion of the machine chamber, and a top panel which includes an air blowing port of the blower is provided on the top face of the housing.

In Japanese Patent No. 5402987, a fan guard for protecting the blower is attached to the top panel. The fan guard includes a lateral rail portion in which a plurality of soft steel wire rods are arranged in parallel to each other in a lateral direction (the left-right direction of the housing), and a longitudinal rail portion in which a plurality of soft steel wire rods are arranged in parallel to each other in the longitudinal direction (the front-rear direction of the housing), and is formed into a rectangular lattice shape in which the crossing portions between the lateral rail portion and the longitudinal rail portion are welded and the surfaces thereof are subsequently covered with a vinyl chloride resin.

In Japanese Patent No. 5402987, screw fastening portions are formed at the four corners of the fan guard, each of the end portions of the lateral rail portion being formed into a loop shape by being bent in a U shape (refer to FIG. 4 of Japanese Patent No. 5402987). By screwing the screw fastening portions to the top panel of the housing, the fan guard is fixed to the housing.

However, since the fan guard which is described in Japanese Patent No. 5402987 uses soft steel wire rods, when a person stands on the fan guard, when an object falls onto the fan guard, or the like and a great load is applied, the fan guard is easily deformed. Since the fan guard which is described in Japanese Patent No. 5402987 is screwed at the four corners, the fan guard is easily deformed.

In Japanese Patent No. 5402987, in order to stack the outdoor units during transportation, the fan guard is stored inside a fan guard attachment portion which is formed by recessing a portion of the top face panel so as not to protrude from the top of the top panel such that it is possible to support an upper outdoor unit using the frame of a lower outdoor unit. Therefore, since there is little clearance between the fan guard and the blower, when the deformation amount of the fan guard is great, the fan guard comes into contact with the blower, and the blower may be damaged. Since the fan guard is directly screwed to the top panel, the vibration of the blower and the compressor is propagated to the top panel, and the top panel and the fan guard may bump against each other to generate a chattering sound. In order to prevent the generation of the chattering sound, the fan guard may be more strongly fixed to the housing; however, this is unfavorable since the number of screw fastening portions and screws, and the workload of the screw fastening work are increased.

SUMMARY OF THE INVENTION

An object of the present invention is to provide an outdoor unit of an air conditioner which is capable of increasing the mechanical strength of a fan guard to suppress deformation of the fan guard, and further, is capable of preventing generation of a chattering sound.

An aspect of the present invention relates to an outdoor unit of an air conditioner which includes a blower in an inner portion of a housing, in which a top panel which includes an air blowing port of the blower is provided on a top face of the housing, and a fan guard attachment portion to which a fan guard which covers the air blowing port is attached is provided as a concave portion of a predetermined depth in the top panel. The fan guard includes a lateral rail portion and a longitudinal rail portion, and a left-right pair of fixing plates which are fixed continuously from the front end to the rear end of both end portions of either the lateral rail portion or the longitudinal rail portion. Each of the fixing plates is formed in a cross-sectional crank shape which includes a base portion which is fixed to the fan guard attachment portion, a standing portion which stands up from one end of the air blowing port side of the base portion toward the top, and a supporting portion which extends from a distal end of the standing portion toward a direction distancing from the base portion, in which an end portion of the lateral rail portion or the longitudinal rail portion is supported by the supporting portion, and the fan guard is fixed to the fan guard attachment portion via the fixing plates.

In a more favorable aspect, the longitudinal rail portion is disposed on the lateral rail portion, an end portion of the lateral rail portion is supported on a lower face side of the supporting portion, and a standing height H of the standing portion is greater than a diameter $\phi 1$ of the lateral rail portion ($H>\phi 1$) such that the lateral rail portion does not come into contact with the fan guard attachment portion.

According to an aspect of the present invention, by continuously fixing from the front end to the rear end of both ends of the lateral rail portion or the longitudinal rail portion of the fan guard using fixing portions, and performing the fixing to the top panel via the fixing portions, it is possible to increase the mechanical strength of the fan guard and suppress the deformation. Since the lateral rail portion does not directly come into contact with the top panel, it is possible to prevent the fan guard from touching the top panel to generate a chattering sound.

DETAILED DESCRIPTION OF THE INVENTION

Next, description will be given of an embodiment of the present invention with reference to the drawings; however, the present invention is not limited thereto.

Figure 1:
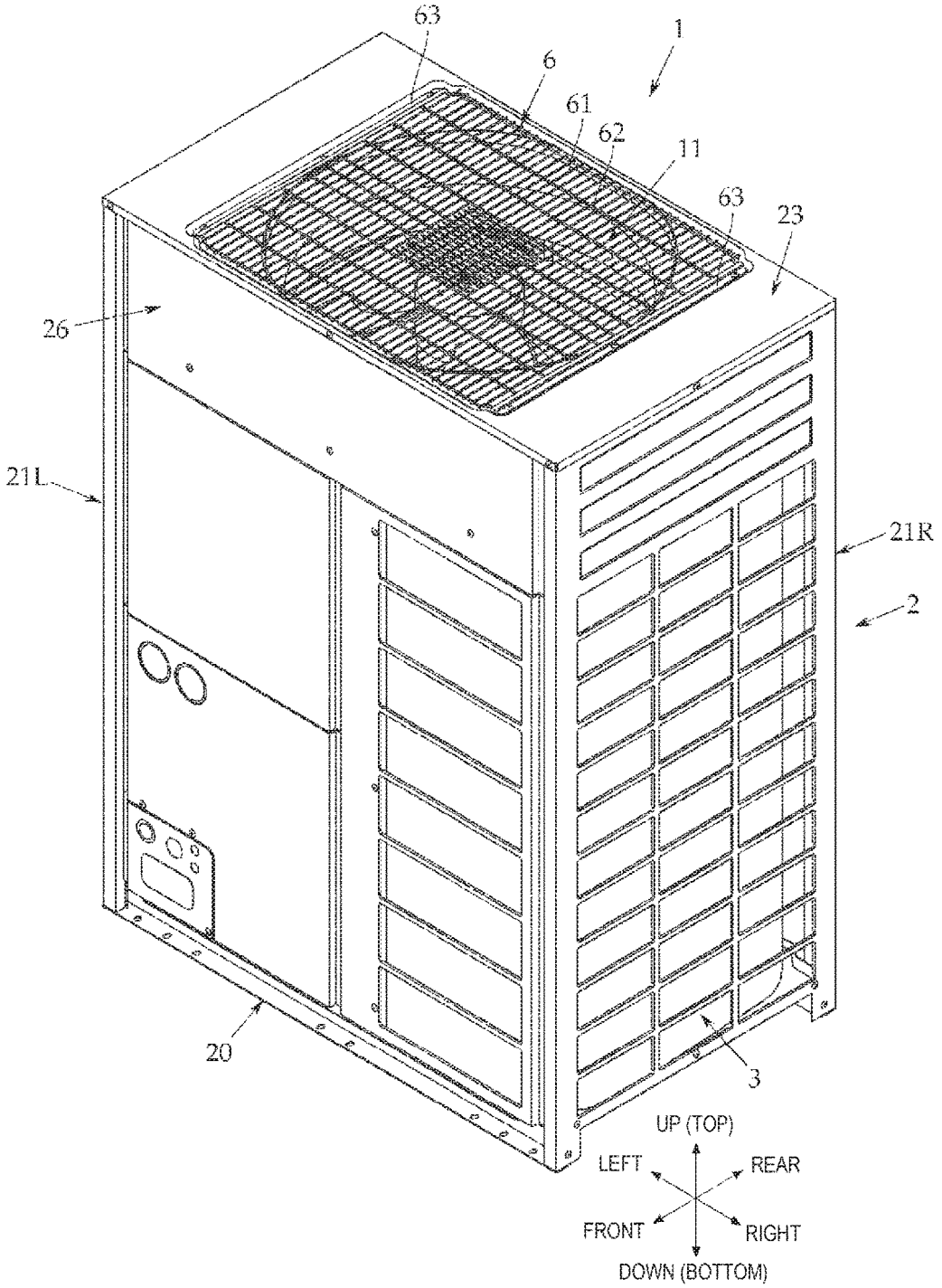
FIG. 1 is a perspective view of an outdoor unit of an air conditioner according to an embodiment of the present invention.
Figure 2:
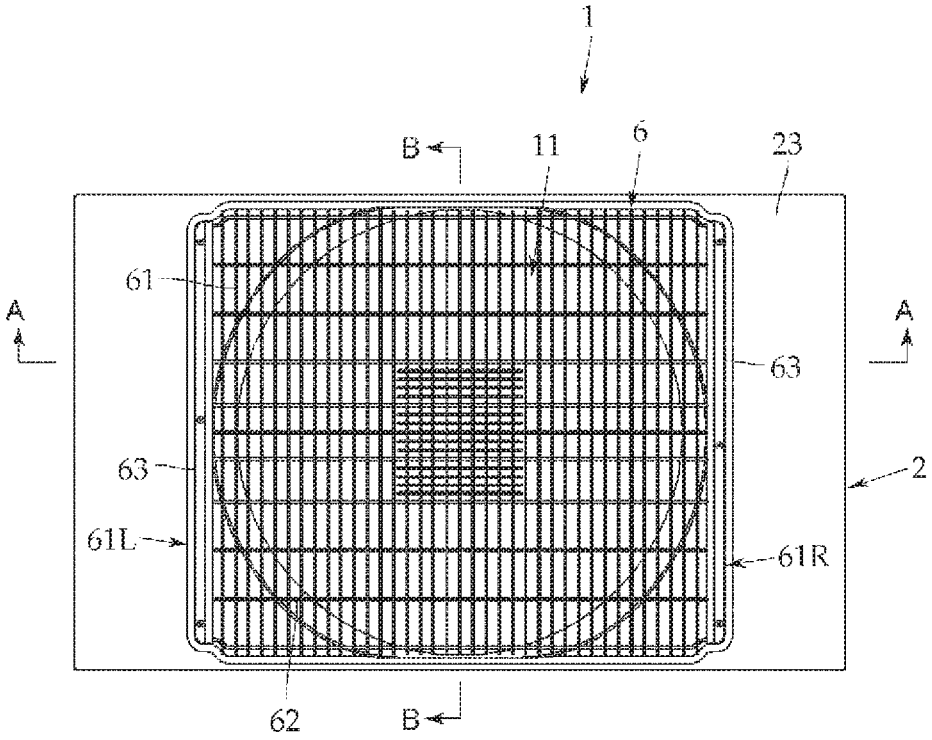
FIG. 2 is a plan view of the outdoor unit of the air conditioner.
Figure 3:
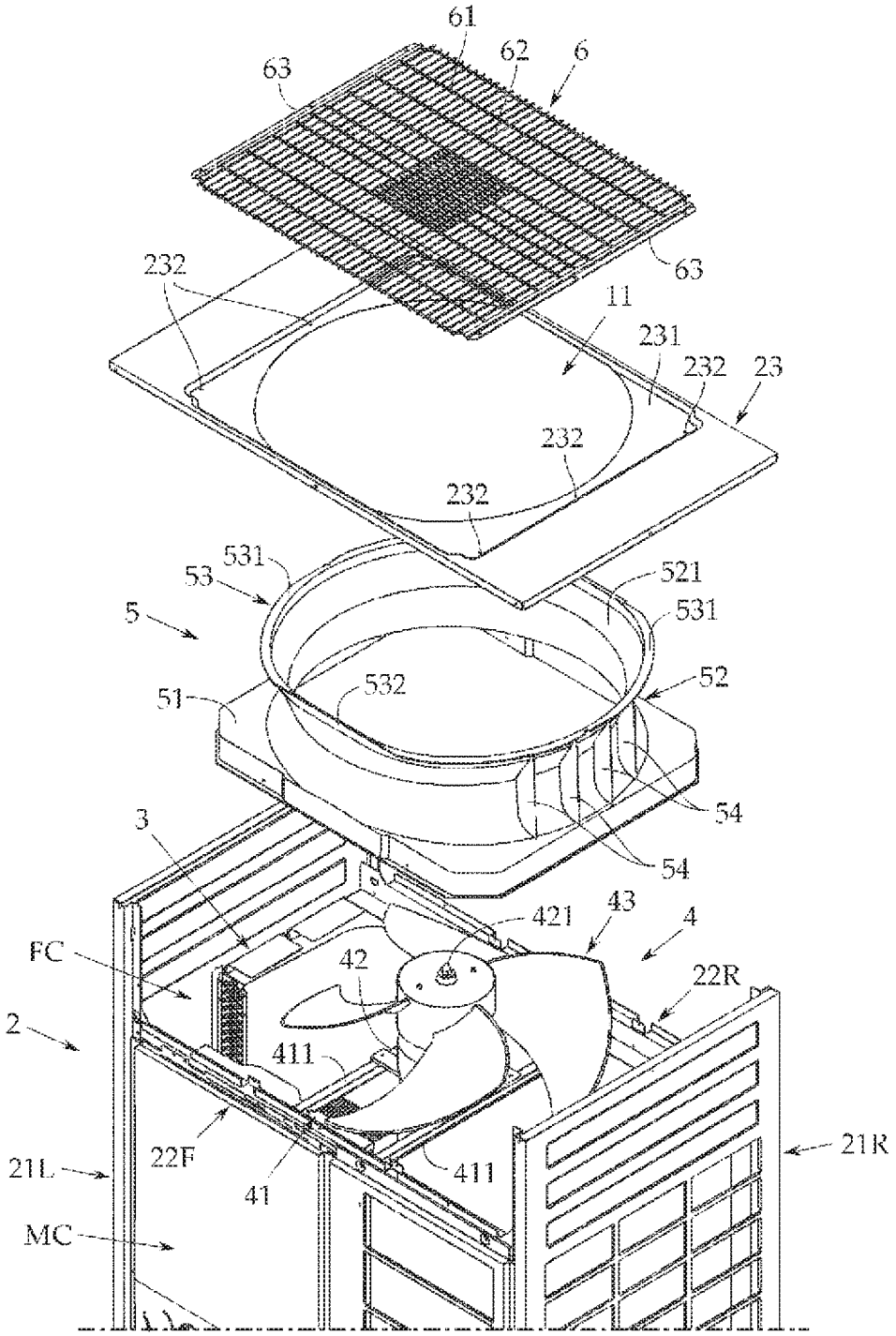
FIG. 3 is an exploded perspective view in which a portion of the outdoor unit of the air conditioner is exploded.
Figure 4:
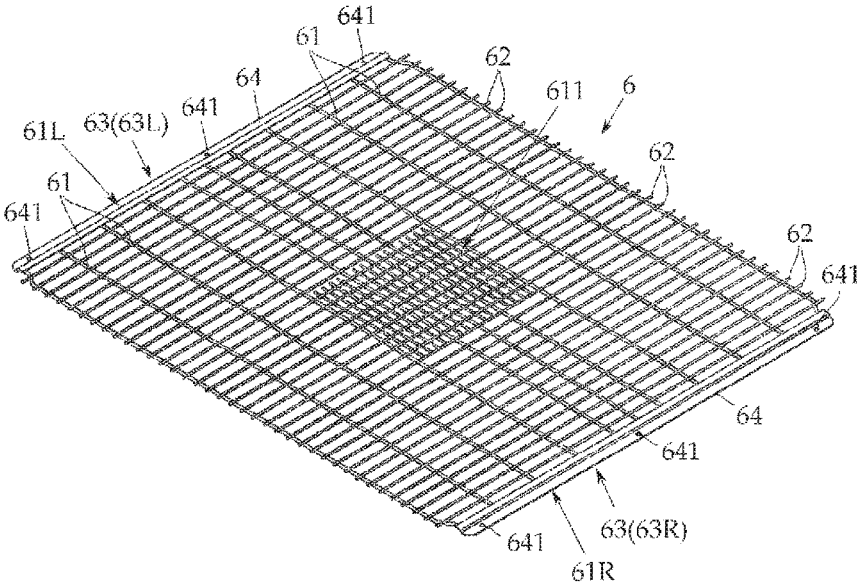
FIG. 4 is a perspective view of a fan guard of the outdoor unit of the air conditioner.
Figure 5:
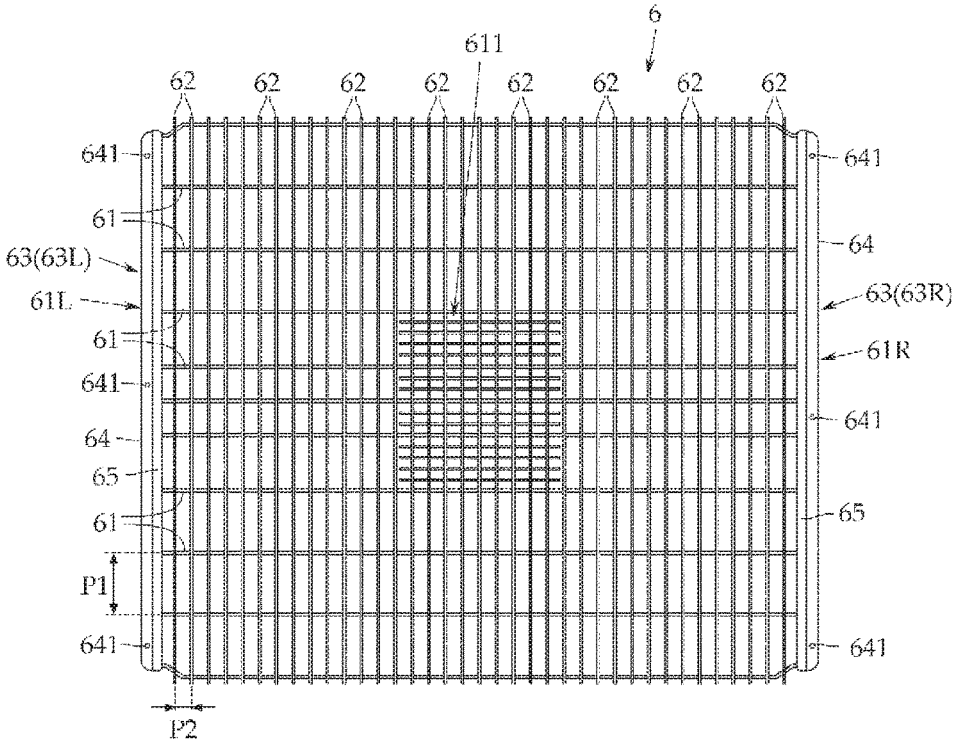
FIG. 5 is a front view of the fan guard.

As illustrated in FIGS. 1 to 3, an outdoor unit 1 of the air conditioner includes a housing 2 which has a rectangular parallelepiped shape which is horizontally long in the left-right direction (the left-right direction in FIG. 1). The inner portion of the housing 2 is partitioned into a machine chamber MC which includes a heat exchanger 3, a compressor, and the like (not illustrated), and a blower chamber FC which includes a blower 4. In the embodiment, the machine chamber MC is disposed on the bottom portion inside the housing 2, and the blower chamber FC is disposed above the machine chamber MC.

The housing 2 is provided with a base panel 20, a left side panel 21L, a right side panel 21R, a front beam 22F (refer to FIG. 3), and a rear beam 22R (refer to FIG. 3) as the basic structure of the housing 2. The base panel 20 is installed on an installation surface and has a longitudinal shape, the left side panel 21L is provided to stand on the left side end of the base panel 20, the right side panel 21R is provided to stand on the right side end of the base panel 20, the front beam 22F is horizontally bridged between the front end of the left side panel 21L and the front end of the right side panel 21R, and the rear beam 22R is horizontally bridged between the rear end of the left side panel 21L and the rear end of the right side panel 21R.

In the embodiment, the front beam 22F and the rear beam 22R are disposed on the heat exchanger 3 of the machine chamber MC of the housing 2 to form a boundary with the blower chamber FC. The front beam 22F and the rear beam 22R are horizontally disposed to be on the same horizontal plane as each other.

A front panel 26 is attached to the front face of the machine chamber MC of the housing 2. The front panel 26 is a horizontally long metal panel which blocks the front face of the machine chamber MC, both left and right ends of the front panel 26 are screwed to the front end of the left side panel 21L and the right side panel 21R, the top end side is screwed to a top panel 23, and the bottom side is screwed to the front beam 22F.

A rear panel (not illustrated) which is similar to the front panel 26 is attached to the rear face side of the machine chamber MC of the housing 2. The rear panel is a horizontally long metal panel which blocks the rear face of the machine chamber MC, both left and right ends of the rear panel are screwed to the rear end of the left side panel 21L and the right side panel 21R, the top end side is screwed to the top panel 23, and the bottom side is screwed to the rear beam 22R.

A motor bracket 41 on which the blower 4 is mounted is provided on the front beam 22F and the rear beam 22R. The motor bracket 41 includes a pair of beam members 411 and 411 which are bridged between the front beam 22F and the rear beam 22R in parallel. The beam members 411 and 411 are screwed and fixed to the front beam 22F and the rear beam 22R.

A fan motor 42 of the blower 4 is mounted on the motor bracket 41, and a propeller fan 43 is attached to a rotation shaft 421 of the fan motor 42. A bell mouth 5 of the blower 4 is further provided in the blower chamber FC.

The bell mouth 5 is provided with a bell mouth main body 52 which protrudes upward from the top face of a rectangular stand portion 51 and is disposed to surround the outer circumference of the propeller fan 43. In the stand portion 51, the front end is placed on and screwed to the front beam 22F, and the rear end is placed on and screwed to the rear beam 22R. The bell mouth main body 52 is formed in an approximately straight tube shape from the stand portion 51 to the attachment position of the propeller fan 43, and the opening diameter of the bell mouth main body 52 is formed to gradually become larger from the top end of the propeller fan 43 toward a top end opening 521 (the top end in FIG. 3).

A flange portion 53 is formed on the top end of the bell mouth main body 52 from the top end of the bell mouth main body 52 toward the outer circumferential direction parallel to the stand portion 51. In the embodiment, the flange portion 53 includes a first flange portion 531 and a second flange portion 532, and the width of the first flange portion 531 is formed bigger than the width of the second flange portion 532. The first flange portion 531 is provided to protrude toward the left-right direction (the left-right direction in FIG. 3) of the bell mouth main body 52, and the second flange portion 532 is provided to protrude toward the front-rear direction (the front-rear direction in FIG. 3) of the bell mouth main body 52.

The outer circumference of the side face of the bell mouth main body 52 is provided with reinforcing ribs 54 for increasing the mechanical strength of the bell mouth main body 52. The reinforcing ribs 54 are formed on the side face of the bell mouth main body 52 so as to be parallel to each other in an up-down direction, and in the embodiment, and are provided in four locations on each of the left and right side faces (a total of eight locations).

On the top face of the housing 2 (the top face of the blower chamber MC), the top panel 23 is fixed to the top end of the left side panel 21L and the top end of the right side panel 21R. The top panel 23 is a horizontally long metal panel which blocks the top face of the housing 2, and an air blowing port 11 of the blower 4 is formed in the center of the top panel 23.

Figure 6A:
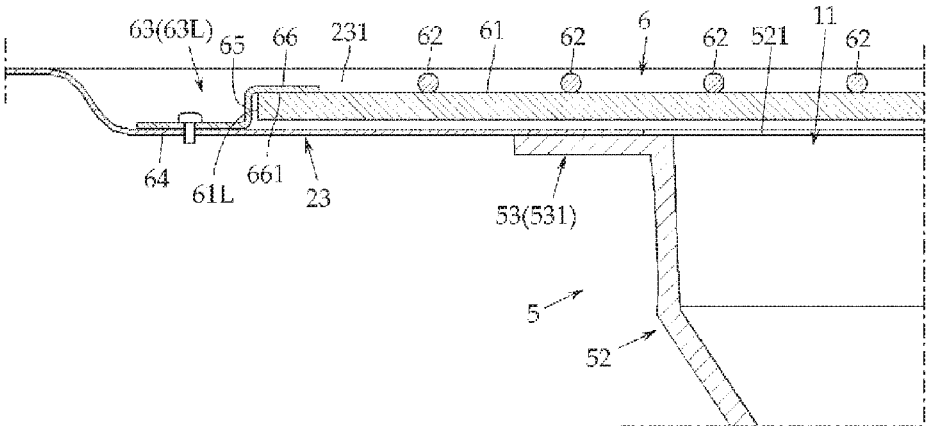
FIG. 6A is a sectional view of an A-A line portion of FIG. 2.
Figure 6B:
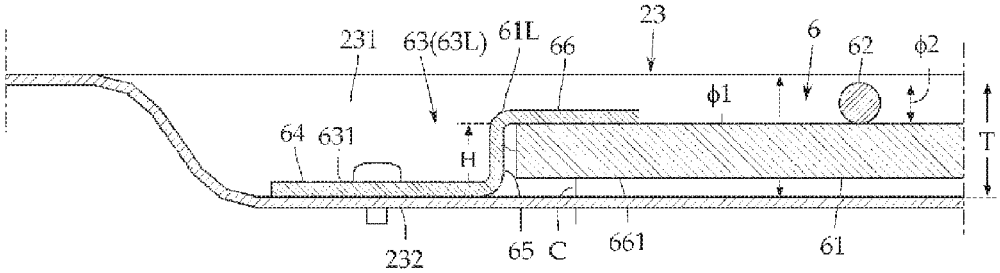
FIG. 6B is an enlarged sectional view of a portion of FIG. 6A.
Figure 7:
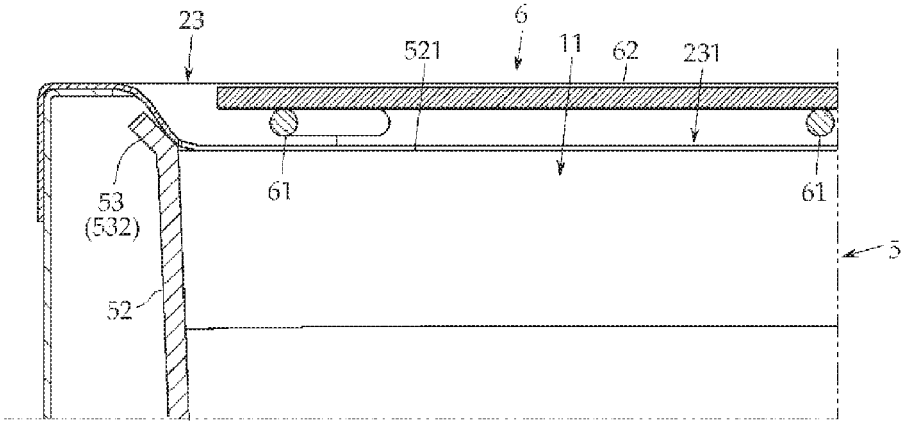
FIG. 7 is a sectional view of a B-B line portion of FIG. 2.

The air blowing port 11 is formed to match the top end opening 521 of the bell mouth main body 52, as illustrated in FIGS. 6A to 7, the flange portion 53 of the bell mouth main body 52 is configured to come into contact with the rear face (back face) of the top panel 23.

Accordingly, since the bottom end of the bell mouth 5 is fixed to the front beam 22F and the rear beam 22R, the load which is applied to the top panel 23 is also applied to the bell mouth 5 and is transmitted from the bell mouth 5 to the front beam 22F and the rear beam 22R, and so the housing 2 receives the load.

As illustrated in FIG. 3, a fan guard attachment portion 231 to which a fan guard 6 (described later) is screwed is provided on the top panel 23. The fan guard attachment portion 231 is a concave portion which is formed a level lower to match the outer shape of the fan guard 6 from the top face of the top panel 23 in the periphery of the air blowing port 11. In the embodiment, screw holes 232 are provided in three locations on each of the left and right sides of the fan guard attachment portion 231.

With reference to FIGS. 6A and 6B, when the depth of the fan guard attachment portion 231 is D and the height of the fan guard 6 is T, the fan guard attachment portion 231 is formed to satisfy depth D>height T. Accordingly, the fan guard 6 is stored inside the fan guard attachment portion 231 so as not to protrude from the top of the top panel 23.

Next, with reference to FIGS. 4 to 7, the fan guard 6 includes a lateral rail portion 61, a longitudinal rail portion 62, and a left-right pair of fixing plates 63. The lateral rail portion 61 extends in the left-right direction of the top panel 23 and is formed from a plurality of wire rods which are disposed parallel to each other at a predetermined interval P1, the longitudinal rail portion 62 extends in the front-rear direction of the top panel 23 and is formed from a plurality of wire rods which are disposed parallel to each other at a predetermined interval P2, and the fixing plates 63 continuously extend from the front end to the rear end of both end portions 61L and 61R of the lateral rail portion 61.

The lateral rail portion 61 and the longitudinal rail portion 62 are both formed on the fan guard 6 of the embodiment using soft steel wire rods. When the diameter of the wire rods of the lateral rail portion 61 is $\phi 1$ and the diameter of the wire rods of the longitudinal rail portion 62 is $\phi 2$, a design is adopted in which the diameter $\phi 1$ of the lateral rail portion 61 is greater than the diameter $\phi 2$ of the longitudinal rail portion 62 ($\phi 1 > \phi 2$).

In the present invention, in the fan guard 6, the thick wire rods with the diameter $\phi 1$ are used as the lateral rail portion 61, and the thin wire rods with the diameter $\phi 2$ are used as the longitudinal rail portion 62. Accordingly, it is possible to increase the mechanical strength of the fan guard 6 by attaching the fan guard attachment portion 231 to the lateral rail portion 61 which has a thick diameter. As a result, it is possible to prevent deformation of the fan guard 6.

In the fan guard 6, the lateral rail portion 61 and the longitudinal rail portion 62 are disposed in a lattice shape such that the intervals P1 and P2 of the lateral rail portion 61 and the longitudinal rail portion 62 satisfy P1≥P2, respectively. In the embodiment, the interval P2 is designed to be approximately one third of the interval P1. Accordingly, by disposing the longitudinal rail portion 62 with the interval P2 being narrow while securing the mechanical strength of the fan guard 6 using the lateral rail portion 61, it is possible to prevent objects from passing through the fan guard 6 and falling into the blower 4, to prevent fingers from entering from the gaps in the fan guard 6, and the like.

As illustrated in FIGS. 6A and 6B, the longitudinal rail portion 62 is disposed on the top face (the top face in FIG. 6A) of the lateral rail portion 61, and after welding the intersecting portions of the longitudinal rail portion 62 and the lateral rail portion 61, the surfaces thereof are coated with a vinyl chloride resin. The fixing method, the fixing locations, and the coating process of the lateral rail portion 61 and the longitudinal rail portion 62 are arbitrarily modifiable according to the specifications.

In the embodiment, auxiliary rail portions 611 are provided on the center portion of the fan guard 6 parallel along the lateral rail portion 61 and at a predetermined interval between the wire rods of the lateral rail portion 61. Although blown air does not leave from the center portion of the propeller fan 43, there is a case in which a vortex is generated. The auxiliary rail portion 611 is provided in order to suppress the occurrence of a vortex.

The fixing plates 63 are provided with a left fixing plate 63L and a right fixing plate 63R. The left fixing plate 63L is formed continuously from the front end to the rear end (from the bottom left end to the top left end in FIG. 5) of the left end portion 61L of the lateral rail portion 61, and the right fixing plate 63R is formed continuously from the front end to the rear end (from the bottom right end to the top right end in FIG. 5) of the right end portion 61R of the lateral rail portion 61. Since the left fixing plate 63L and the right fixing plate 63R have the same shape, hereinafter, description is given only of the left fixing plate 63L.

With reference to FIGS. 6A and 6B, the left fixing plate 63L is formed in a cross-sectional crank shape which is formed by press molding a single metal plate, and includes a base portion 64, a standing portion 65, and a supporting portion 66. The base portion 64 is fixed to the top panel 23, the standing portion 65 stands up from one end of the base portion 64 toward the top of the top panel 23, and the supporting portion 66 is parallel to the base portion 64 from the far end of the standing portion 65 and extends from the base portion 64 toward a direction distancing from the base portion 64.

The base portion 64 is attached along the bottom portion of the fan guard attachment portion 231 of the top panel 23, and three screw holes 641 are bored in the front end, the center, and the rear end of the base portion 64. The standing portion 65 is provided to stand vertically from one end (the right end in FIGS. 6A and 6B) of the base portion 64 toward the top of the top panel 23, and is formed such that a height H is greater than the diameter $\phi 1$ of the lateral rail portion 61 ($H > \phi 1$).

The supporting portion 66 is bent in approximately a right angle from the top end (the top end in FIGS. 6A and 6B) of the standing portion 65, is formed parallel to the top panel 23, and the lateral rail portion 61 is fixed along a lower face 661 of the supporting portion 66 using spot welding or the like, for example.

Accordingly, as illustrated in FIGS. 6A and 6B, both of the end portions 61L and 61R of the lateral rail portion 61 are fixed to the lower face 661 of the supporting portion 66 and the height H of the standing portion 65 is set to be greater than the diameter $\phi 1$ of the lateral rail portion 61, and so, since a predetermined air gap C is secured between the lower surface of the lateral rail portion 61 and the base surface of the fan guard attachment portion 231, the lateral rail portion 61 and the fan guard attachment portion 231 are prevented from generating a chattering sound due to coming into contact due to vibration.

Since both of the end portions 61L and 61R of the lateral rail portion 61 of the fan guard 6 are screwed to the top panel 23 via the fixing plate 63, even if a large load is applied to the fan guard 6, since the mechanical strength of the lateral rail portion 61 is increased, it is possible to suppress the deformation such that there is only a little deformation.

In the embodiment, the top panel 23 is formed in a rectangular shape which is horizontally long to the left and right, the fan guard 6 which is horizontally long is formed on the top panel 23, the lateral rail portion 61 is disposed along the left-right direction of the top panel 23, and the longitudinal rail portion 62 is disposed along the front-rear direction of the top panel 23. For example, in a case in which the top panel is a rectangular shape or the like, an aspect in which the lateral rail portion 61 is disposed in the front-rear direction of the top panel 23 and the longitudinal rail portion 62 is disposed in the left-right direction of the top panel 23 is included in the present invention. In this manner, it is possible to arbitrarily change the orientation of the lateral rail portion 61 and the longitudinal rail portion 62 of the fan guard 6 in accordance with the shapes of the top panel 23 and the fan guard attachment portion 231.

As is described hereunto, according to the present invention, by continuously fixing from the front end to the rear end of both ends of the lateral rail portion of the fan guard using fixing plates, and performing the fixing to the top panel via the fixing plates, since the mechanical strength of the fan guard is increased, it is possible to suppress the deformation. Since the lateral rail portion does not directly come into contact with the top panel, it is possible to prevent the fan guard from touching the top panel to generate a chattering sound.

What is claimed is:

1. An outdoor unit of an air conditioner, comprising:

a housing;

a blower disposed in an inner portion of the housing;

a top panel provided on a top face of the housing and including an air blowing port for the blower, and a fan guard attachment portion having a concave portion with a bottom, the fan guard attachment portion surrounding the air blowing port; and a fan guard disposed in the fan guard attachment portion to cover the air blowing port, the fan guard including a lateral rail portion, a longitudinal rail portion overlapping the lateral rail portion to form a rectangular shape, and a pair of fixing plates disposed at two opposing end portions of the lateral rail portion or the longitudinal rail portion, each of the pair of fixing plates being formed in a cross-sectional crank shape and extending along an entirety of each of the two opposing end portions of the lateral rail portion or the longitudinal rail portion, each of the pair of fixing plates including a base portion extending along the bottom of the concave portion and fixed to the fan guard attachment portion, a standing portion extending from one end of the base portion in a direction away from the bottom of the concave portion, and a supporting portion extending from the standing portion in a direction away from the base portion and toward the air blowing port, the supporting portion having a lower face facing the bottom of the concave portion and to which each of the end portions of the lateral rail portion or the longitudinal rail portion is fixed, wherein the fan guard is fixed to the fan guard attachment portion via the pair of fixing plates so that the fan guard is arranged below an upper surface of the top panel, and the lateral rail portion and the longitudinal rail portion do not contact the bottom of the concave portion.

2. The outdoor unit of an air conditioner according to claim 1, wherein the longitudinal rail portion is disposed on the lateral rail portion, each of the end portions of the lateral rail portion is supported on the lower face of the supporting portion, and a standing height of the standing portion between the bottom of the concave portion and the supporting portion is greater than a diameter of the lateral rail portion such that the lateral rail portion does not come into contact with the fan guard attachment portion.

3. The outdoor unit of an air conditioner according to claim 1, wherein the fan guard further comprises an auxiliary rail portion at a center portion thereof, the auxiliary rail portion including a plurality of wire rods arranged along the lateral or longitudinal rail portion so that an interval between the plurality of wire rods of the fan guard is less than an interval between rods of either the lateral rail portion or the longitudinal rail portion.

4. The outdoor unit of an air conditioner according to claim 1, further comprising a bell mouth housed inside the housing and surrounding an outer circumference of the blower, the bell mouth including a flange portion at a top end thereof, the flange portion contacting the top panel and having a pair of first flange portions extending radially outwardly of the bell mouth and arranged opposite to each other in respect to the blower; and a pair of second flange portions inclined in respect to the pair of first flange portions in a direction perpendicular to a radial direction of the bell mouth, each of the pair of second flange portions being arranged between the pair of first flange portions and connected to the pair of first flange portions, wherein the top panel further includes an inclined portion defining an outer periphery of the concave portion and having an inclination abutting against the pair of second flange portions, and the pair of first flange portions and the pair of second flange portions of the bell mouth support the top panel from an underside of the top panel.

5. The outdoor unit of an air conditioner according to claim 4, wherein the top panel further comprises an outer peripheral portion extending outwardly from the outer periphery of the concave portion and extending downwardly to cover an outer side of the flange portion of the bell mouth.

* * * * *